US006265857B1

(12) United States Patent
Demsky et al.

(10) Patent No.: US 6,265,857 B1
(45) Date of Patent: Jul. 24, 2001

(54) CONSTANT CURRENT SOURCE CIRCUIT WITH VARIABLE TEMPERATURE COMPENSATION

(75) Inventors: Kevin Paul Demsky; John Farley Ewen; Matthew James Paschal, all of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/218,340

(22) Filed: Dec. 22, 1998

(51) Int. Cl.[7] ..... G05F 3/08
(52) U.S. Cl. ..... 323/312; 323/907
(58) Field of Search ..... 323/312, 313, 323/315, 907; 327/513

(56) References Cited

U.S. PATENT DOCUMENTS

| | | | | |
|---|---|---|---|---|
| 4,636,742 | | 1/1987 | Oritani | 330/256 |
| 4,819,241 | | 4/1989 | Nagano | 372/38 |
| 4,899,152 | | 2/1990 | Barrow et al. | 341/154 |
| 4,958,155 | | 9/1990 | Gulczynski | 341/120 |
| 5,019,769 | | 5/1991 | Levinson | 372/31 |
| 5,125,112 | | 6/1992 | Pace et al. | 455/343 |
| 5,134,398 | | 7/1992 | Yasutake et al. | 341/119 |
| 5,198,701 | * | 3/1993 | Davies et al. | 327/513 |
| 5,283,631 | | 2/1994 | Koerner et al. | 307/451 |
| 5,430,395 | * | 7/1995 | Ichimaru | 327/312 |
| 5,629,612 | * | 5/1997 | Schaffer | 323/313 |
| 5,812,582 | | 9/1998 | Gilliland et al. | 372/50 |
| 5,910,751 | | 6/1999 | Winn et al. | 327/560 |
| 6,069,501 | | 5/2000 | Hachiya et al. | 327/83 |
| 6,084,462 | | 7/2000 | Barker | 327/83 |
| 6,181,191 | | 1/2001 | Paschal | 327/513 |

OTHER PUBLICATIONS

Winn et al., "Circuit Arrangement and Method with Temperature Dependent Signal Swing," U.S. Ser. No. 08/800, 608, filed Feb. 14, 1997, Notice of Allowance mailed Oct. 26, 1998.

* cited by examiner

*Primary Examiner*—Adolf Deneke Berhane
(74) *Attorney, Agent, or Firm*—Roy W. Truelson; Karuna Ojanen

(57) ABSTRACT

The constant current source circuit provides current that compensates for changes in performance resulting from changes of temperature. The circuit mixes variable amounts of current having a negative temperature coefficient with current having a positive temperature coefficient. Analog and digital embodiments of the circuit are disclosed. In the analog embodiment, the amount of current having a positive temperature coefficient is added to an amount of current having a negative temperature coefficient as determined by the voltage difference between a variable control voltage input to transistors and a bandgap reference voltage. A transistor in each of two current selectors is connected to the variable control voltage, one of which is connected to ground and the other of which is output; and another transistor in each current selector is connected to the reference voltage, and again one transistor is grounded and the other is output whose current is mixed with the output from the transistor in the first current selector connected to the variable control voltage. A continuous range of temperature coefficients are realizable by varying the control voltage with respect to the bandgap reference voltage. The digital embodiment has a digital-to-analog converter connected to a bias voltage from the current having a positive temperature coefficient and a second digital-to-analog converter connected to a second bias voltage from the current having a negative temperature coefficient. A digital input signal to a corresponding switch determines if its respective transistor in each of the digital-to-analog converters conduct current. The two digital-to-analog converters may be configured in a common centroid arrangement of integrated complementary unit cells. The constant current source circuit can be used to drive off-chip parallel loads such as VCSELs.

14 Claims, 17 Drawing Sheets

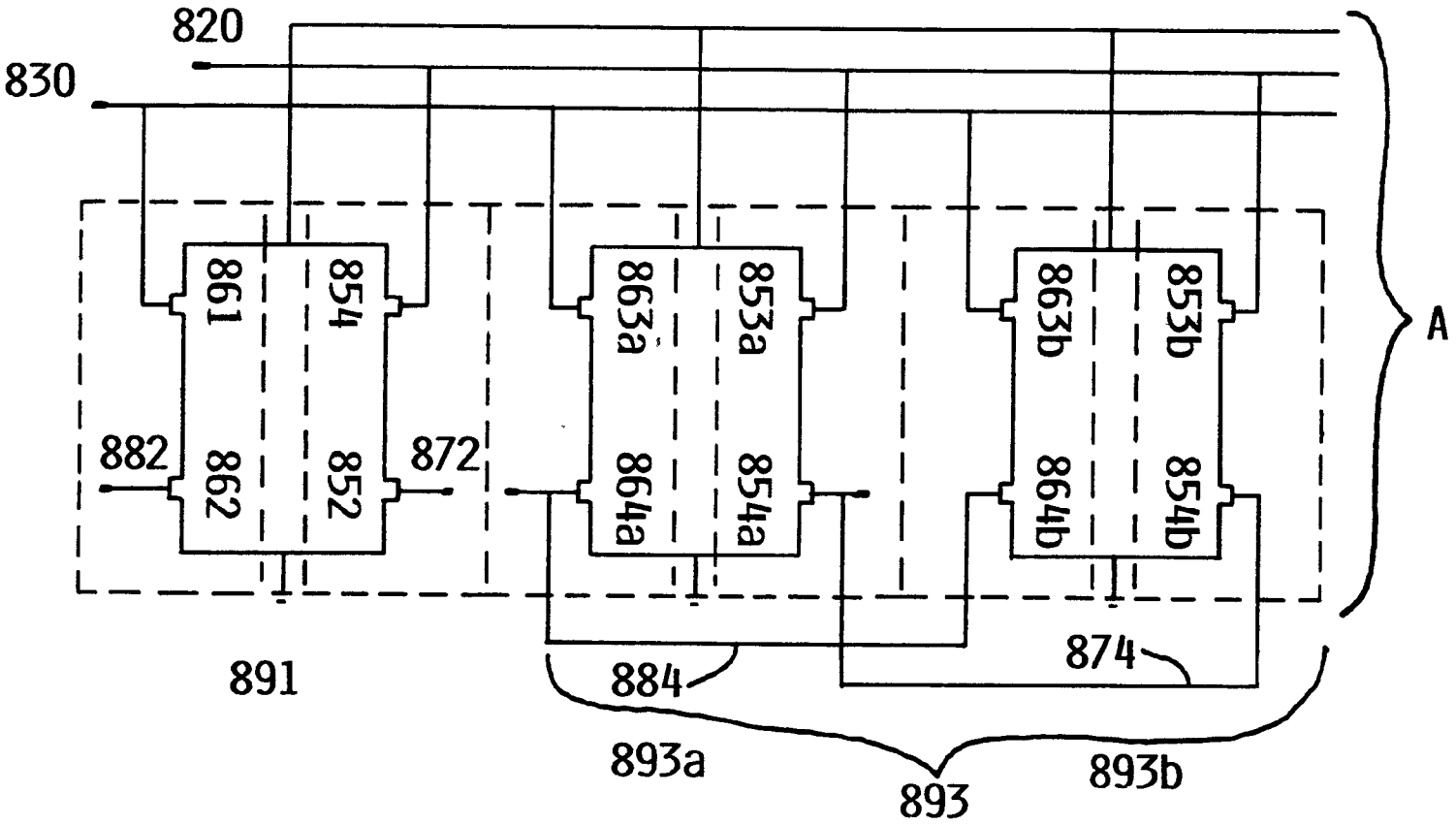
FIG. 8D-I

| | | | Column 0 | Column 1 | Col. 2 | Col. 3 | Col. 4 | Col. 5 |
|---|---|---|---|---|---|---|---|---|
| row 0 | | | D_T | D_T | D_T | D_T | D_T | D_T |
| row 1 | | | D | 32 | 16 | 32 | 16 | 32 |
| row 2 | | | D | 4 | 32 | 8 | 32 | 8 |
| row 3 | | | D | 32 | 16 | 32 | 16 | 32 |
| row 4 | | | D | 2 | 32 | 8 | 32 | 1 |
| row 4a | D_T | D_T | | | | | | |
| row 5 | D | R | R | 32 | 16 | 32 | 16 | 32 |
| row 6 | D | R | R | 4 | 32 | 8 | 32 | 8 |
| row 7 | D | R | R | 32 | 16 | 32 | 16 | 32 |
| row 8 | D_B | D_B | D_B | D_B | D_B | D_B | D_B | D_B |

A

FIG. 9A

| Col. 6 | Col. 7 | Col. 8 | Col. 9 | Col. 10 |
|---|---|---|---|---|
| D_T | D_T | D_T | D_T | D_T |
| 16 | 32 | 16 | 32 | D |
| 32 | 8 | 32 | 4 | D |
| 16 | 32 | 16 | 32 | D |
| 32 | 8 | 32 | 2 | D |
| 16 | 32 | 16 | 32 | D |
| 32 | 8 | 32 | 4 | D |
| 16 | 32 | 16 | 32 | D |
| D_B | D_B | D_B | D_B | D_B |

A

FIG. 9B

CONSTANT CURRENT SOURCE CIRCUIT WITH VARIABLE TEMPERATURE COMPENSATION

This invention relates generally to temperature compensation of electronic circuits and more particularly to a circuit having selectable temperature coefficients to provide constant current to stabilize the performance of a load. The load may be an optoelectronic circuit, such as a parallel array of vertical cavity surface emitting lasers (VCSELs), affected by temperature.

BACKGROUND OF THE INVENTION

It is well known that electronic circuits generate thermal energy which increases the temperature of the circuit and affects its performance; for example, the output of current sources and current mirrors vary with temperature. The output current of one of these current sources, moreover, may drive or bias loads located on an integrated circuit or chip other than the current source and which may also have either unpredictable or unknown responses to changes of temperature. Such an off chip load having an unpredictable or unknown temperature coefficient is the vertical cavity surface emitting laser (VCSEL), a semiconductor laser which emits light parallel to the direction of the optical cavity.

Predicting the necessary bias currents in a VCSEL has been difficult because VCSELs have not been thoroughly or consistently characterized for industrial purposes, and manufacturing processes are also variable. It is known that a VCSEL operates at a higher frequency if the current is modulated between a level just above its light emitting threshold current and a level which results in emission of maximum optical power, instead of the VCSEL current being turned off and on. It is also known that both the light emitting threshold current and the differential quantum efficiency which determines the maximum optical power of a VCSEL drift with temperature. Therefore, a tunable means to provide a current which can compensate for temperature variation of either or both the threshold current or the current for maximum emission of the VCSEL is required.

To compensate for temperature variations of a constant current source or mirror, a bandgap reference may be used to obtain a zero temperature coefficient. Also, a constant current source having either a negative temperature coefficient or a positive temperature coefficient may be used for compensation. In any of the three former cases, once the temperature coefficient is set by choosing semiconductor device dimensions, i.e., emitter widths, resistor values, or MOSFET device dimensions, and the circuit is manufactured, the temperature coefficient cannot be changed. Any of these methods, moreover, do not compensate for changes of the temperature coefficient in the load. A known technique to moderate a load to control its performance that changes with temperature variations is to provide feedback to the current source driving the load. For instance, the optical output power of a VCSEL can be monitored and when the optical power requires adjustment, current driving the VCSEL is increased or decreased, as needed, to maintain constant optical output. When VCSELs or other optical devices are placed for parallel optical transmission, monitoring the output of each optical device becomes impracticable.

It is thus an object of the invention to provide an analog version and a digital version of a constant current source with a range of adjustable temperature coefficients to compensate for temperature effects. The range of temperature coefficients can be from a positive value to a negative value including flat temperature response. The current output which is temperature-compensated can be used to drive parallel loads.

SUMMARY OF THE INVENTION

Thus, a constant current source circuit is provided wherein the current sources comprises a first current source having a positive coefficient of temperature compensation to generate a first bias voltage, and a second current source having a negative coefficient of temperature compensation to generate a second bias voltage, a first current selector connected to the first bias voltage and a second current selector connected to the second bias voltage, and an output current derived from selectively combining current from the first and second current selector. Each of the first and second current selectors may comprise two transistors, one transistor connected to a variable control voltage and the second transistor connected to a reference voltage. The transistors may be bipolar transistors, npn bipolar transistors, p-channel enhancement MOSFETs, n-channel enhancement MOSFETs, p-channel depletion MOSFETs, n-channel depletion MOSFETs, GASFETs, or JFETs. In an embodiment, as the variable control voltage increases, the partial derivative of the output current with respect to temperature decreases. In another embodiment of the invention, as the variable control voltage decreases, the partial derivative of the output current with respect to temperature increases. Yet another manifestation of the invention, as the variable control voltage increases, the partial derivative of the output current with respect to temperature increases. And yet another embodiment of the invention permits the partial derivative of the output current with respect to temperature to decrease as the variable control voltage decreases.

The invention is further embodied in a constant current source circuit, comprising a first current source having a positive coefficient of temperature compensation to generate a first bias voltage, a second current source having a negative coefficient of temperature compensation to generate a second bias voltage, at least one first transistor connected to the first bias voltage and at least one second transistor connected to the second bias voltage. The circuit further comprises a first programmable enable switch connected to the first transistor to enable the first transistor to conduct current having a positive coefficient of temperature compensation and a second programmable enable switch connected to the second transistor to enable the second transistor to conduct current having a negative coefficient of temperature compensation so that output current is a combined current from those transistors which have been enabled to conduct current. An inverter between and connecting the first programmable enable switch and the second programmable enable switch may be provided and the first and second transistors may have the same physical dimensions, such that only one of the first or second transistor is on at any one time. The first transistor and first programmable enable switch, and the second transistor and second programmable enable switch may be configured into an integrated complementary unit cell.

An embodiment of a constant current source circuit is provided which comprises a first n-bit digital-to-analog converter electrically connected to a first current source having a positive coefficient of temperature compensation, where $n \geqq 1$, and a second m-bit digital-to-analog converter electrically connected to a second current source having a negative coefficient of temperature compensation, where $m \geqq 1$. The constant current source circuit of this embodiment further comprises at least n first programmable enable lines connected to the first n-bit digital-to-analog converter and at least m second programmable enable lines connected to the second m-bit digital-to-analog converter so that a mixed output of a first current output of the first digital-to-analog converter is added to a second current output of the second digital-to-analog converter having a net temperature coefficient determined by the number of the first and the second programmable enable lines that are on. When n=m, the first n-bit digital-to-analog converter and the second m-bit digital-to-analog converter may further comprise $$\sum_{n=0}^{n-1} 2^n$$

integrated complimentary unit cells in a common centroid arrangement.

A constant current source circuit is also provided comprising means to generate a first bias voltage having a positive temperature coefficient, means to generate a second bias voltage having a negative temperature coefficient, a first current generating means responsive to said first bias voltage to generate a first current having a positive temperature coefficient, a second current generating means responsive to said second bias voltage to generate a second current having a negative temperature coefficient, a means to output a mixed current by selectively adding varying amounts of said first current and said second current. The first current generating means may comprise two transistors wherein the gate of a first transistor is connected to the adjustable control voltage and the drain of the first transistor is connected to an output, and wherein the gate of a second transistor is connected to the bandgap reference voltage and the drain of the second transistor connected to ground; and the second current generating means comprises two additional transistors wherein the gate of a third transistor is connected to the adjustable control voltage and the drain of the third transistor is connected to ground, and the gate of a fourth transistor is connected to the bandgap reference voltage and the drain of the fourth transistor connected to the output. The output means adds the outputs of the first and said fourth transistors as determined by the difference between the bandgap reference voltage and the adjustable control voltage. The first current generating means may comprise a first n-bit digital-to-analog converter and the second current generating means may comprise a second m-bit digital-to-analog converter and the output means may comprise means to selectively enable any of the n bits of the first digital-to-analog converter to output a first output current and means to selectively enable any of the m bits of said second digital-to-analog converter to output a second output current. The embodiment also includes means to add the first and the second output currents. The n-bits of the first digital-to-analog converter may be complementary to the m-bits of said second digital-to-analog converter when n=m, and the means to selectively enable the n-bits of the first digital-to-analog converter may further comprise switching means interconnected between the means to selectively enable the m-bits of the second digital-to-analog converter wherein when one of the n-bits of the first digital-to-analog converter is on, the complementary one of the m-bits of the second digital-to-analog converter is off.

The invention may further be understood with reference to the drawings and the detailed description following therefrom.

BRIEF DESCRIPTION OF THE DRAWINGS

FIG. 1*a* is more suitable for pnp bipolar or p-channel MOSFET semiconductor implementation and FIG. 1*b* is more suitable for npn bipolar or n-channel MOSFET semiconductor implementation.

FIG. 2*a* is more suitable for pnp bipolar or p-channel MOSFET semiconductor implementation and 2*b* is more suitable for npn bipolar or n-channel MOSFET semiconductor implementation.

FIG. 9 is the arrangement of integrated complementary unit cells to achieve a six-bit constant current source circuit according to the principles of the invention.

Figure 4A:
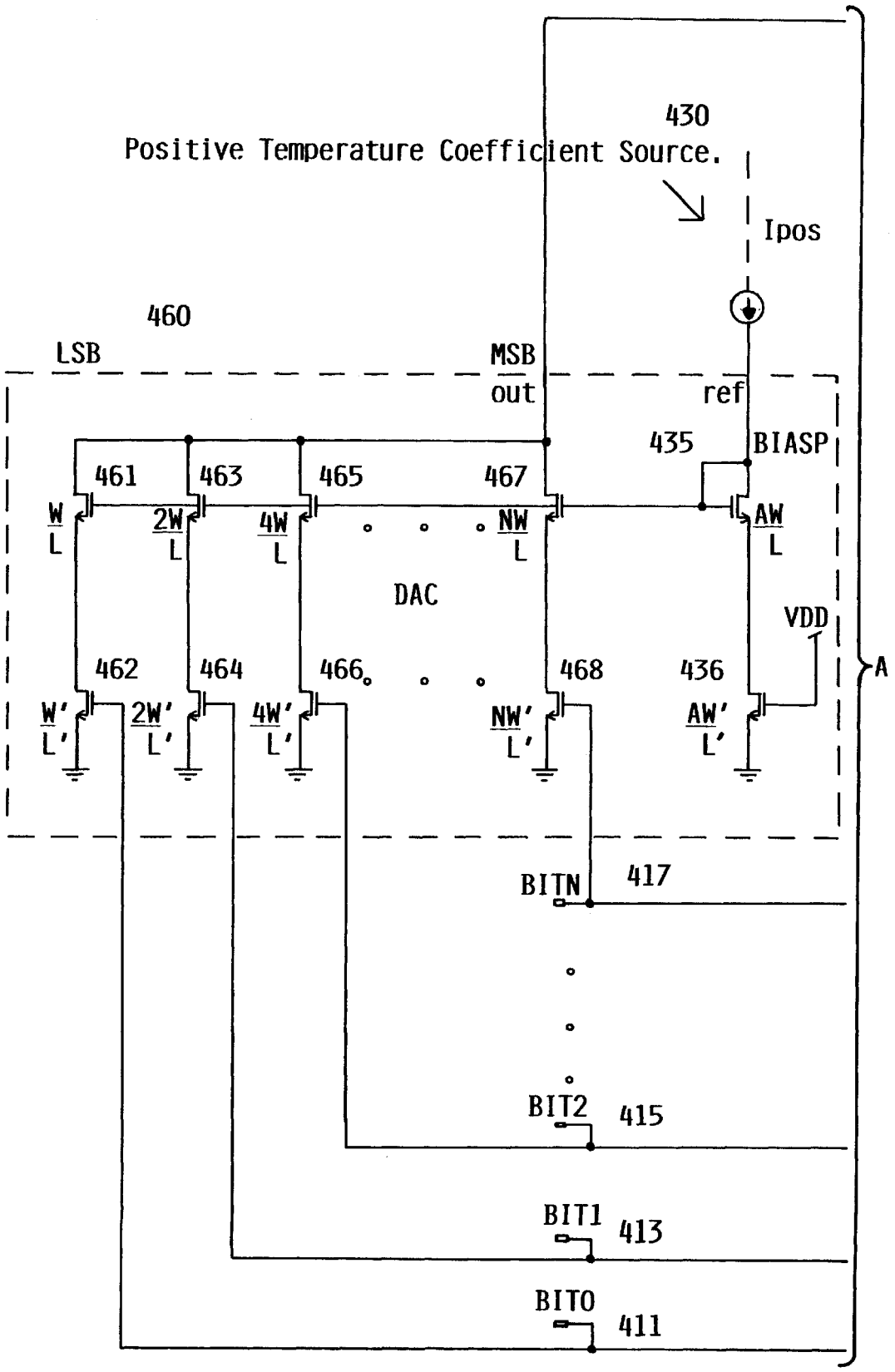
FIG. 4 is a circuit diagram of an embodiment using digital-to-analog converters in the constant current source circuit according to the principles of the invention.
Figure 4B:
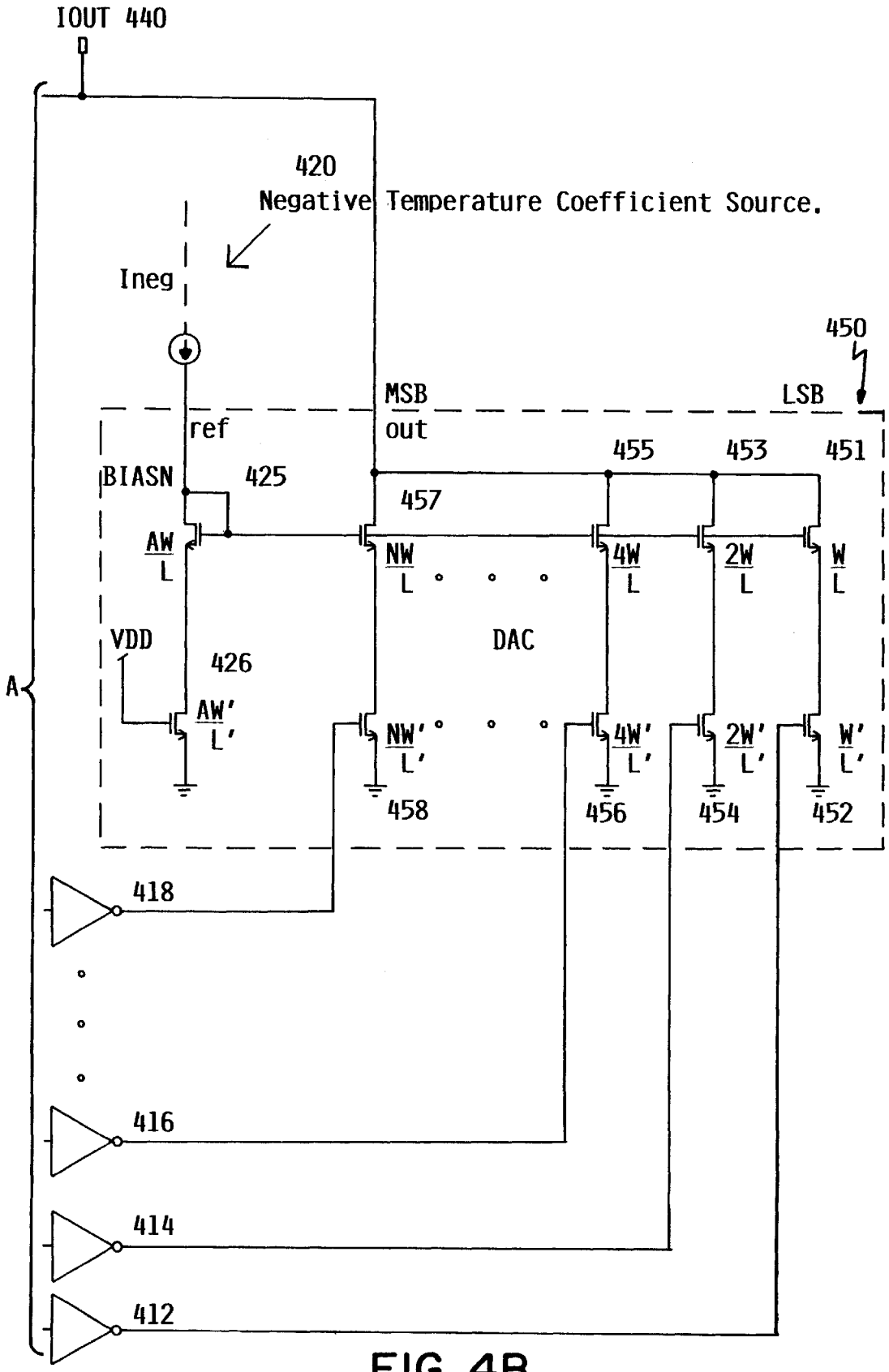

It is suggested that FIG. 4 be printed on the cover of the patent.

DESCRIPTION OF THE PREFERRED EMBODIMENTS

Figure 1A:
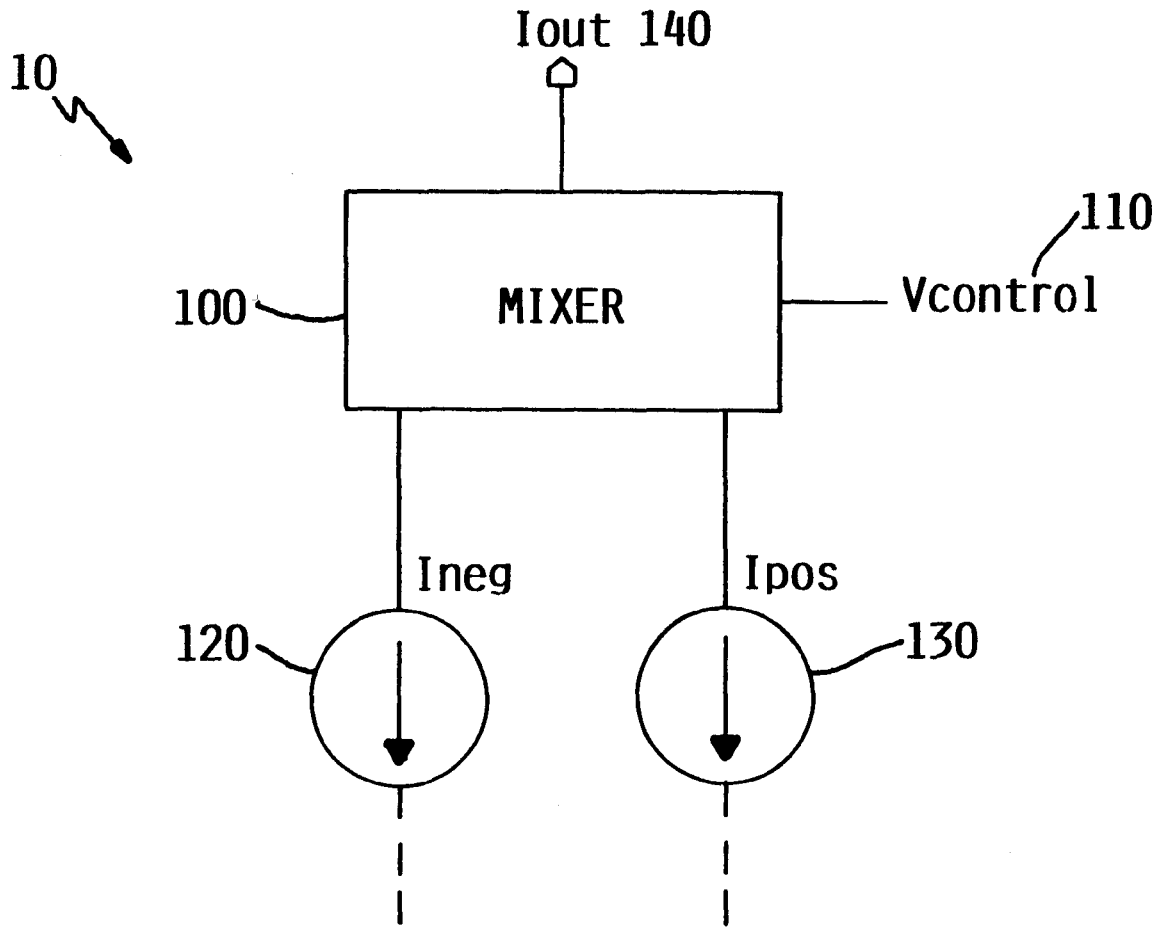
FIG. 1*a* and 1*b* are block diagrams of an analog constant current source circuit according to the principles of the invention.
Figure 1B:
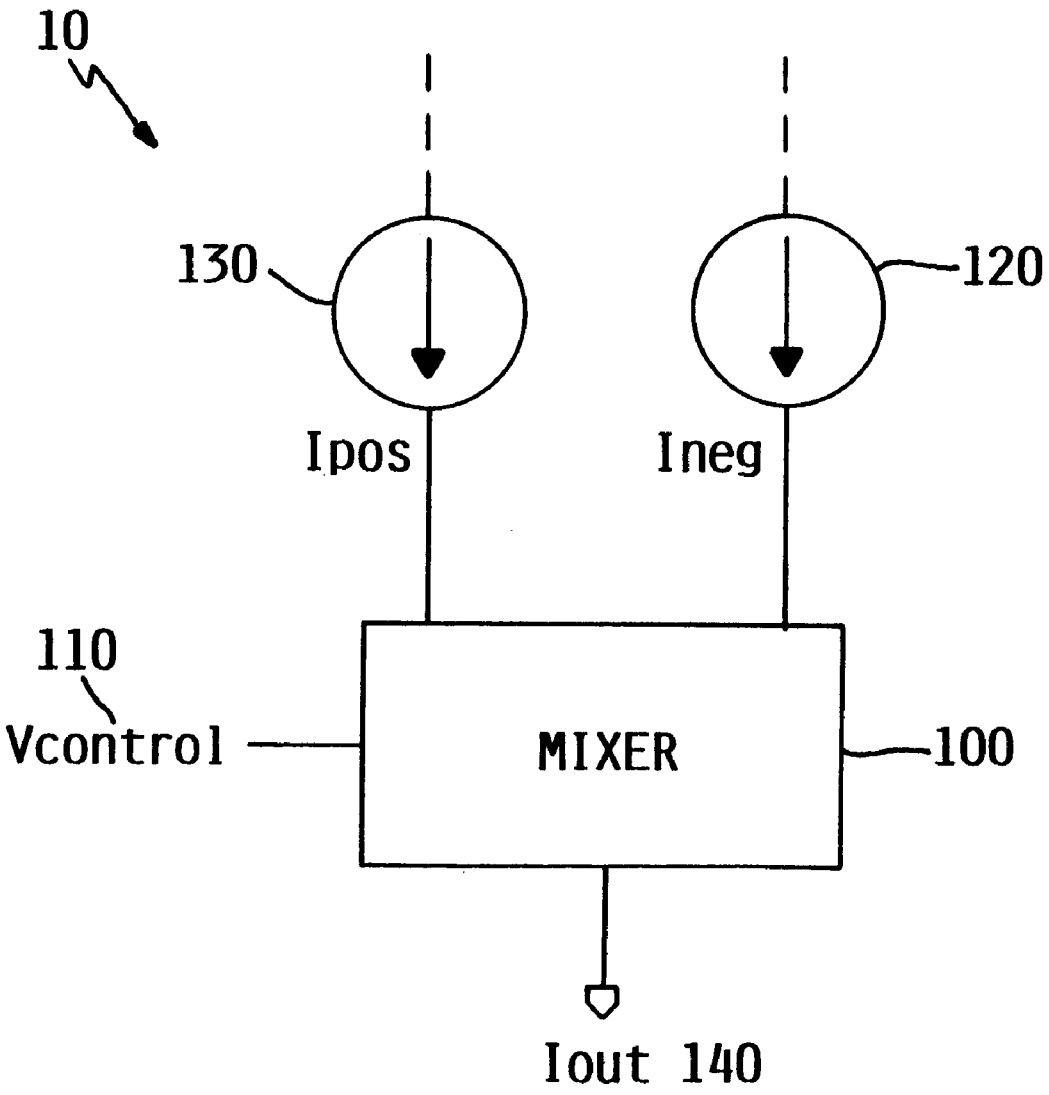

A programmable constant current source circuit mixes current from a current source having a positive temperature coefficient with current from a second current source having a negative temperature coefficient in adjustable proportions. The output current is then applied to a load to compensate for less than optimal performance of the load resulting from its temperature changes. FIGS. 1*a* and 1*b* are block diagrams of a constant current source circuit made and used according to principles of the invention. Two current sources, 120 and 130, are provided. A first current source 120 has a negative temperature coefficient such that as the temperature increases, the amount of current supplied from the current source 120 decreases. Output current from current source 120 decreases when the temperature increases, at an exemplary rate of, by way of example only, −1.3 percent per degree Celsius. A second current source 130 has a positive current source in which current increases as the temperature of the current source 130 increases. Output current from current source 130 increases when the temperature increases, at an exemplary rate of, by way of example only, +1.3 percent per degree Celsius. Current from each source is input into mixer 100 which is controlled by a variable voltage 110 to mix current from each source 120, 130 in any desired proportionality to provide an output current 140.

Current sources 120, 130 may be current generators or current mirrors. In some embodiments of the invention it is preferable that current sources 120, 130 be matched, i.e., that the sources be capable of providing identical magnitude but have opposite sign coefficients, although they certainly need not necessarily be matched. Indeed, envisioned within the scope of the invention are applications wherein one current source provides a larger current and/or has a temperature coefficient greater in magnitude that the other current source. For instance, the two current sources need not have the same magnitude of temperature coefficient; but may differ, e.g., output current from current source 130 may be +1 percent per degree Celsius whereas output current from current source 120 may be −1.5 percent per degree Celsius.

Analog and digital embodiments of the invention are contemplated and presented. FIG. 1*a* is a configuration in which the mixer 100 is made from pnp bipolar or p-channel enhancement MOSFET semiconductor devices, whereas FIG. 1*b* illustrates the circuit components from npn bipolar devices or n-channel enhancement MOSFET semiconductor devices. It is also contemplated that the components may be made from other electronic materials, such as depletion MOSFETs, GASFETs, JFETs, even vacuum tubes or any controllable current source will work according to the principles of the invention herein.

Figure 2A:
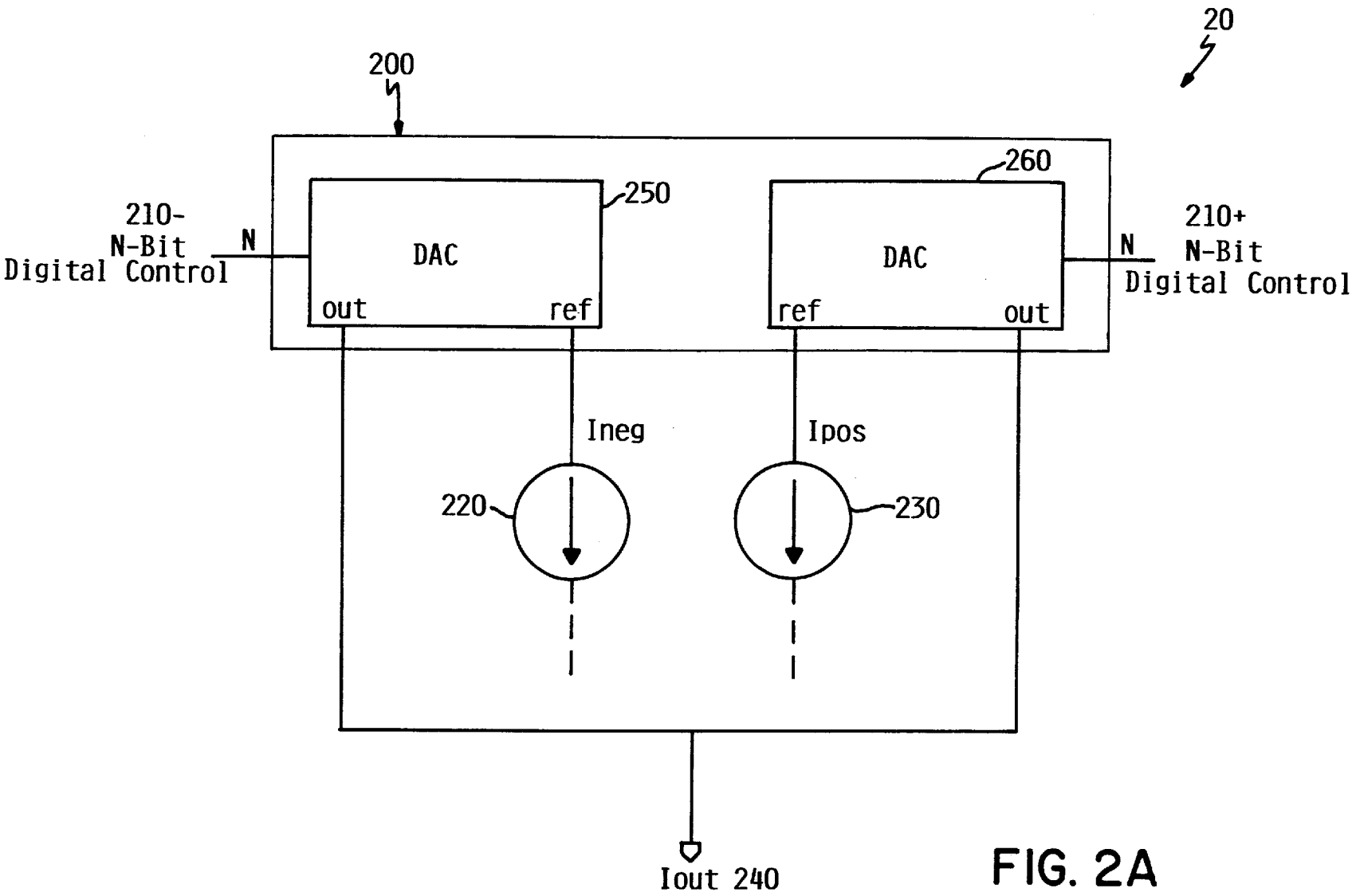
FIGS. 2*a* and 2*b* are block diagrams of a digitally programmable constant current source circuit according to the principles of the invention.
Figure 2B:
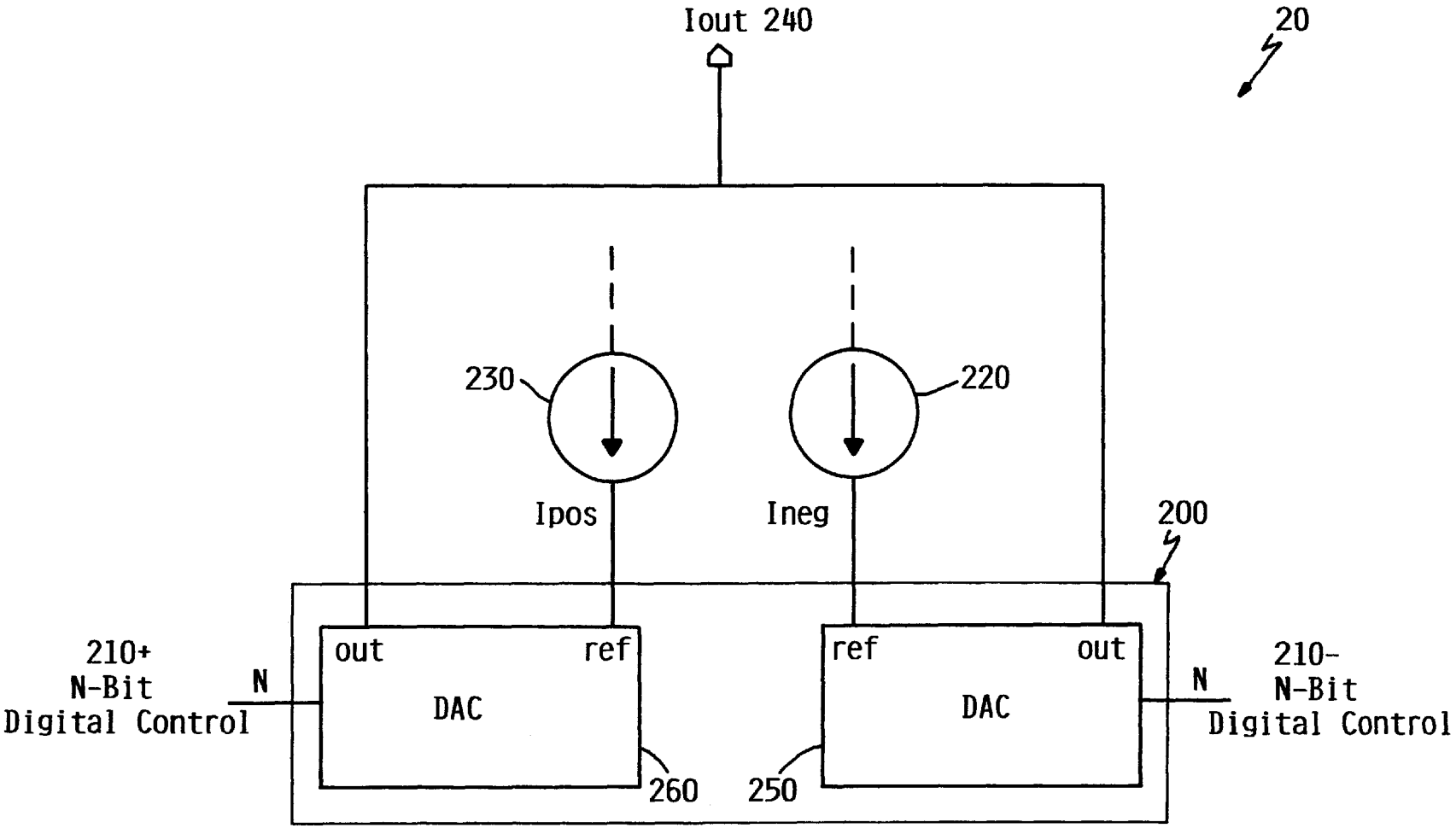

FIGS. 2*a* and 2*b* provide block diagrams of digital embodiments of the invention. Two current sources 220 and 230 having a negative and a positive temperature coefficients, respectively, provide current to a constant current source circuit 200. Constant current source circuit 200 comprises two or more digital-to-analog converters (DACs) 250, 260. Current source 220 having a negative temperature coefficient is connected to digital-to-analog converter 250 and the amount of current output from the digital-to-analog converter 250 is determined by an n-bit digital control 210$^-$. Similarly, current source 230 having a positive temperature coefficient is connected to digital-to-analog converter 260 having an m-bit digital control 210$^+$, where typically m=n but need not be so. Output from the digital-to-analog converters 250 and 260 are combined according to the digital control and are output through an n-type MOSFET 240 in FIG. 2*a* or a p-type MOSFET in FIG. 2*b*. An embodiment is provided wherein the digital-to-analog converters 250 and 260 and the digital control 210$^-$ and 210$^+$ are complementary or inverted, but it is also contemplated that they need not be so.

Figure 3:
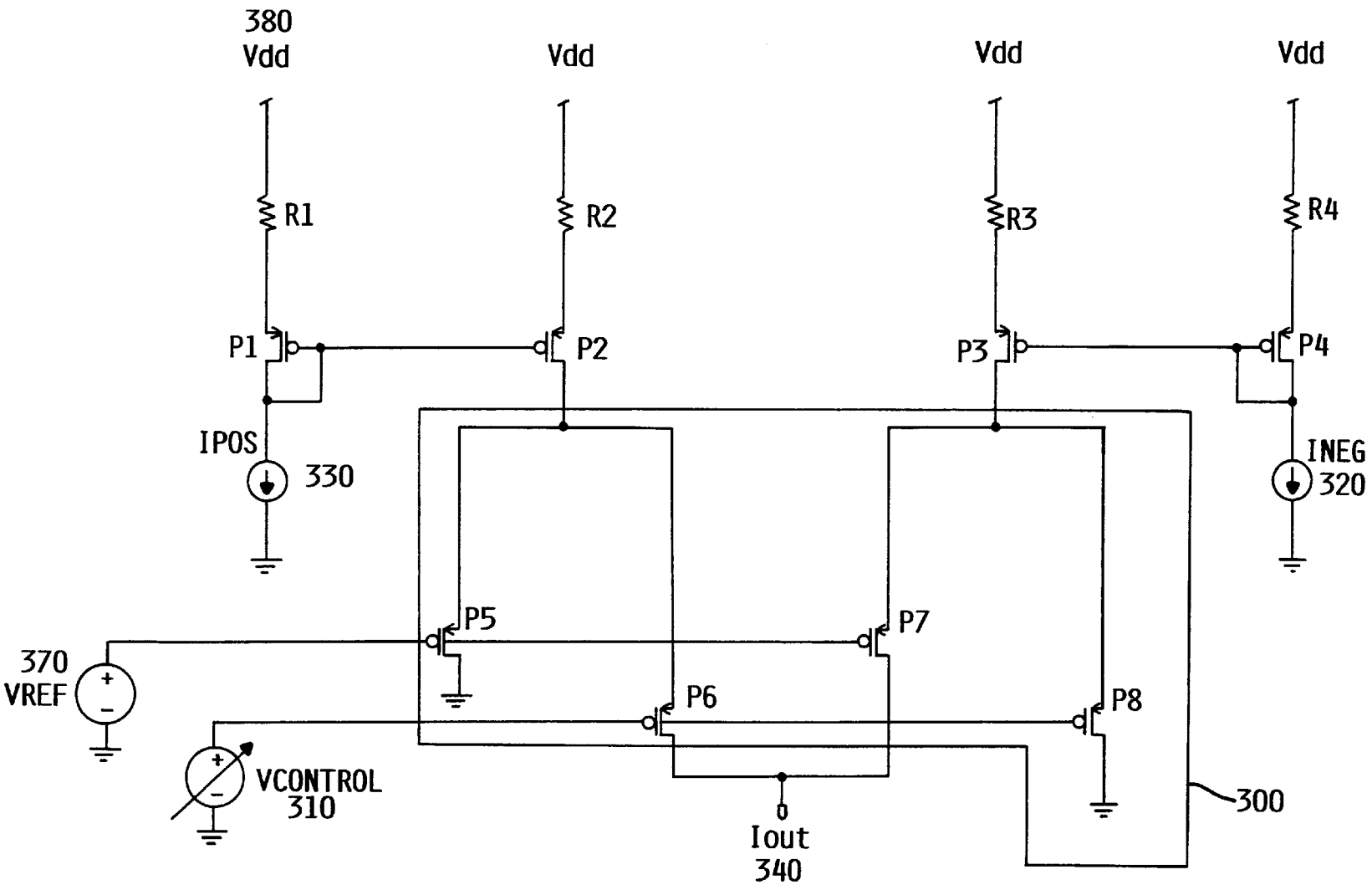
FIG. 3 is a circuit diagram of an analog embodiment of the constant current source circuit according to the principles of the invention.

FIG. 3 is a more detailed version of an analog circuit arrangement of an embodiment of the invention. Current source 330 has a positive temperature coefficient in which the magnitude of the current increases, preferably linearly or otherwise well characterized, with an increase in temperature. Current source 320 has a negative temperature coefficient, meaning that the magnitude of the current increases, again preferably linearly or otherwise well characterized, with a decrease in temperature. Mixing of current from the two current sources 320 and 330 is accomplished using the mixer differential pairs 300. The sources of p-type MOSFETs P1, P2, P3, and P4 are connected through resistors R1, R2, R3 and R4, respectively, to operating voltage, $V_{dd}$, for example, on the order of 3.3 volts. Again, the dimensions of the transistors can be adjusted for current and voltage values necessary to different applications. Attached to the current source 330 having the positive temperature coefficient is P1 with current mirrored to P2. The output of P2 is divided between p-type MOSFETs P5 and P6. Electrically connected to current source 320 with the negative temperature coefficient is P4 with current mirrored to P3. The output of P3 is divided between p-type MOSFETs P7 and P8. Gates of P5 and P7 are connected to a reference voltage, $V_{ref}$, which is a bandgap or other stable voltage source independent of supply and temperature. Gates of P6 and P8 are connected to variable control voltage 310. Variable control voltage 310 provides the variable control to select the temperature coefficient of the total output current by determining the ratio of the current output of P6 and P7 to be combined to output 340. Current output of P5 and P8 are grounded.

The output current 340 from the embodiment of the invention illustrated in FIG. 3 depends upon the difference between the reference voltage 370 and the variable control voltage 310. As variable control voltage 310 increases, the partial derivative of output current 340 with respect to temperature decreases, regardless of device ratios of P5, P6, P7, and P8. As the variable control voltage 310 decreases, the partial derivative of output current 340 with respect to temperature increases regardless of device ratios of P5, P6, P7, and P8. Assuming equal magnitude and opposite sign temperature coefficients for current sources 320 and 330 and assuming W/L for P5, P6, P7, and P8 are equal, then when the control voltage 310 is less than the reference voltage 370, the output current 340 will have a positive temperature coefficient; when the variable control voltage 310 is greater than the reference voltage 370, the output current 340 will have a negative temperature coefficient. The current having a positive temperature coefficient is derived from positive temperature current source 330. From its current mirror P2, the current is divided between P5 and P6, a first current selector. The variable control voltage 310 is connected to the gate of P6 and the stable reference voltage 370 controls the gate of P5. So, when the reference voltage 370 is greater than variable control voltage 310, the current from P6 is greater than the current output of grounded P5. Similarly, current from the negative temperature coefficient source 320 is mirrored to its P3 which is divided equally between P7 and P8, a second current selector. When the reference voltage 370 is greater, more current flows through P8, which is grounded. Upon combination of the current from P6 and P7 and assuming matching values, the output of P6 is greater than the output of P7, therefore the output current 340 will have a positive temperature coefficient.

When the variable control voltage 310 is greater than the reference voltage 370, the current through P5 is greater than the current through P6 but P5 is grounded, so the only source of current to the output current is through P6. Similarly, current through P7 is greater than the current through P8, but P8 is grounded. Upon combination, the current through P7 is greater than the current through P6. Thus, there will be more current having a negative temperature coefficient when the variable control voltage 310 is higher than the reference voltage 370.

If the MOSFETs and current sources are all matched, then as the variable control voltage 310 drops, P5 and P7 are off and P6 has all the current having the positive temperature coefficient and P8 has all the current having the negative temperature coefficient. But P8 is grounded, therefore the output current 340 will be derived from P6 solely. Similarly, as the variable control voltage 310 increases, P6 and P8 turn off, and current having a negative temperature coefficient will be derived solely from P7 because P5 is grounded. If W/L for P5, P6, P7, and P8 are equal and current sources 320 and 330 have temperature coefficients that are equal in magnitude but opposite in sign, then when the variable control voltage 310 equals the reference voltage 370, the same amount of current will be output through P6 and P7 and there will be no temperature compensation.

FIG. 4 is a more detailed version of FIG. 2*b* in which a digital circuit according to the principles of the invention is presented. The current sources having the positive and negative temperature coefficients are shown as 430 and 420, respectively. Connected to the current source having the negative temperature coefficient 420 are transistors 425 and 426; likewise connected to the current source having the positive temperature coefficient 430 are transistors 435 and 436. N-type MOSFETs [hereinafter referred to as nfets] 425, 426, 435, and 436 create a necessary bias voltage from the input current, which bias voltage is connected to the non-switching transistors. Also connected to nfet 425 is a current digital-to-analog converter (DAC) 450 and connected to nfet 435 is a complementary digital-to-analog converter 460. Current digital-to-analog converter 450 comprises a plurality of nfets shown as 451 and its corresponding switch 452, and 453, 455, and 457 and their respective nfet switches 454, 456, 485. Nfet 451 having a width to length ratio of W/L is matched with and connected through switch 452, inverter 412, and switch 462 to its complementary nfet 461 of the same width to length ratio, W/L. Likewise each nfet 453, 455, 457 in digital-to-analog converter 450 is connected to its respective matching complementary nfet 463, 465, 467 in digital-to-analog converter 460 through respective corresponding switches 454 and 464, 456 and 466, 458 and 468 and respective inverters 414, 416, 418. Input bits 411, 413, 415, 417 determine whether the switch to a respective corresponding nfet 452 or 462, 454 or 464, 456 or 466, and 458 or 468 is on or off. If the input bit 411 is high, then the gate of switch 462 is high and 461 is on; the inverter 412 turns the gate of switch 452 low which turns off nfet 451. Thus, with the inverters 412, 414, 416, 418 arranged as illustrated, when the nfet 451, 453, 455, 457 in one digital-to-analog converter 450 is on, then the complementary nfet (461, 463, 465, 467) in the other digital-to-analog converter 460 is off. Discrete changes of temperature coefficients are selectable by inputting a digital signal enabling a specified combination of switches and conductive nfets.

The digital-to-analog converters 450, 460 in FIG. 4 are binary weighted in that nfet 451 has a value of W/L, nfet 453 has a value of 2W/L, nfet 455 has a value of 4W/L up to nfet 457 which has a value nW/L, where n is a whole power of two. A five-bit or six-bit binary weighted digital-to-analog converter has been found to provide sufficient control of the temperature coefficients for most digital applications, including controlling the response to temperature of a VCSEL. Given a different temperature coefficient range, finer tuning can be achieved using more bits for digital control in such applications as calibration of temperature drift of electrical or electro-mechanical systems and devices, adjustment or design of sensors that sense temperature drift and/or designed to compensate for temperature effects.

Using a six-bit binary weighted scheme, then nfets 451 and 461 and the corresponding switches 452 and 462 have a value of W/L, nfets 453 and 463 and corresponding switches 454 and 464 have values of 2W/L; nfets 455 and 465 and switches 456 and 466 have values of 4W/L . . . up to nfets 457 and 467 with corresponding switches 458 and 468 having a value of 32W/L. Other relational schemes besides binary weighting between the values of the transistors, such as non-weighting, simple additive weighting, or exponential or logarithmic weighting are also contemplated as being within the scope of the invention. By way of example, nfets 451 and 461 could have values of W/L, nfets 453 and 463 could have values of 2W/L, nfets 455 and 465 could have values of 3W/L and so on. Binary weighted nfets permit discrete changes of temperature coefficients while offering predictable control by switches, digital counters, or a computer.

Figure 5:
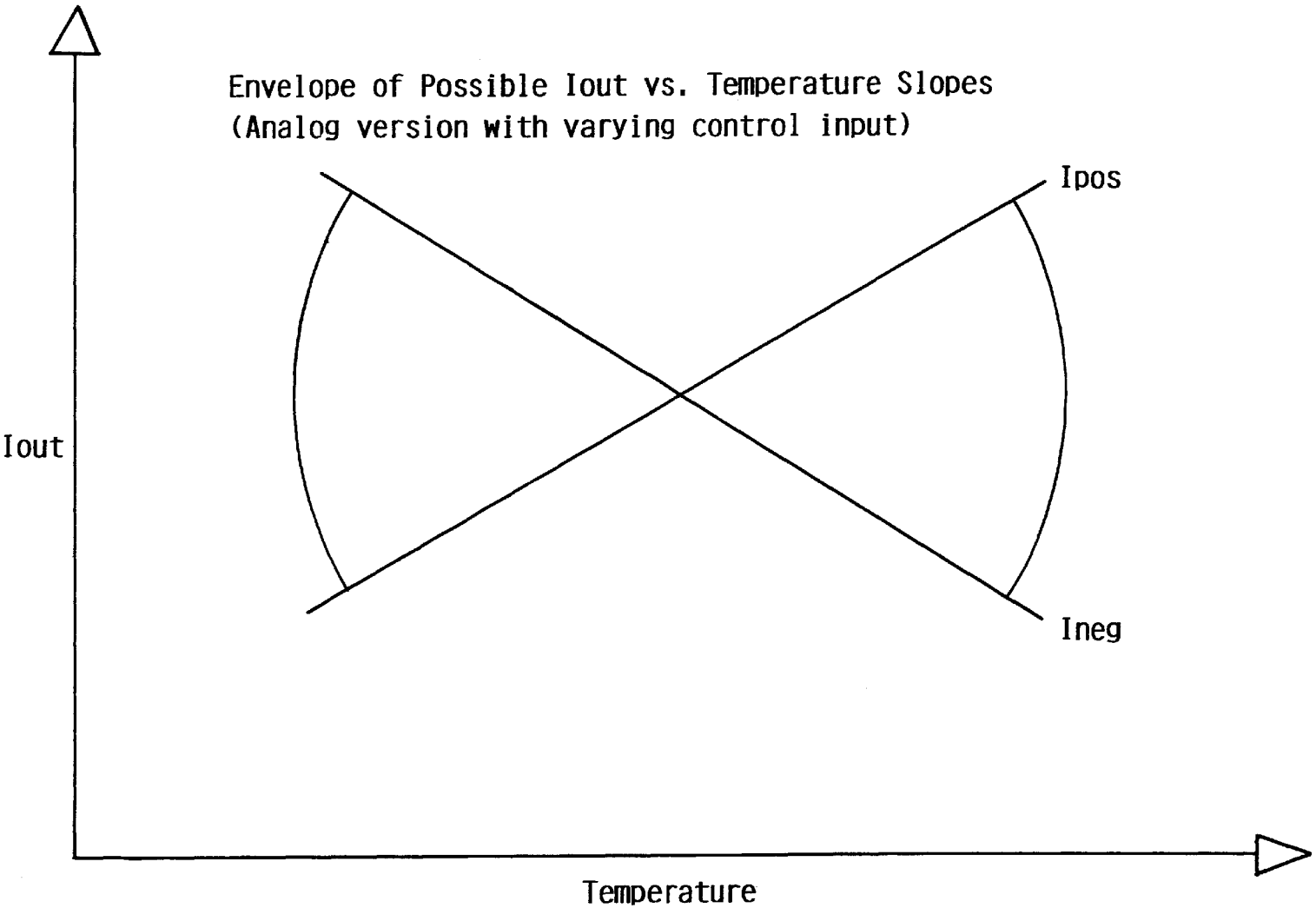
FIG. 5 is a graph of the range of temperature coefficients that may be achieved with an analog embodiment of a constant current source circuit according to the principles of the invention.

FIG. 5 is a fan diagram illustrating the family of temperature coefficients of the output current from the analog constant current source circuit FIG. 3. FIG. 5 illustrates an analog constant current source circuit and its range of temperature coefficients. By varying the control voltage 310 on the analog constant current source circuit of FIG. 3, the output current may have any temperature coefficient in the shaded region between the line indicated by Ineg and the line indicated by Ipos.

Key to both the analog and the digital version of the constant current source circuits is the result that the magnitude of the total current does not change; rather it is the temperature coefficient associated with the current that varies. As an example, if the load driven by the output current is a VCSEL and if the optical power output of the VCSEL has a negative optical power temperature coefficient, then the optical power output decreases with increasing temperature at constant current. To maintain constant optical output power throughout a temperature range, the VCSEL with the negative temperature coefficient has to be compensated by additional current from a current source having a positive temperature coefficient. If the temperature coefficient of the VCSEL and the current source temperature coefficient match in magnitude, but are opposite in sign, constant direct current bias power will be supplied to the load. With the constant current source circuit described herein, moreover, a new temperature coefficient of the driver can be selected by changing the input if the temperature coefficient of the driven load, such as the VCSEL, falls out of specification, changes with age, or if a different supplier is utilized. If the temperature coefficient of the load is unknown at the time of manufacture, tunability flexibility could be an advantage.

Figure 6:
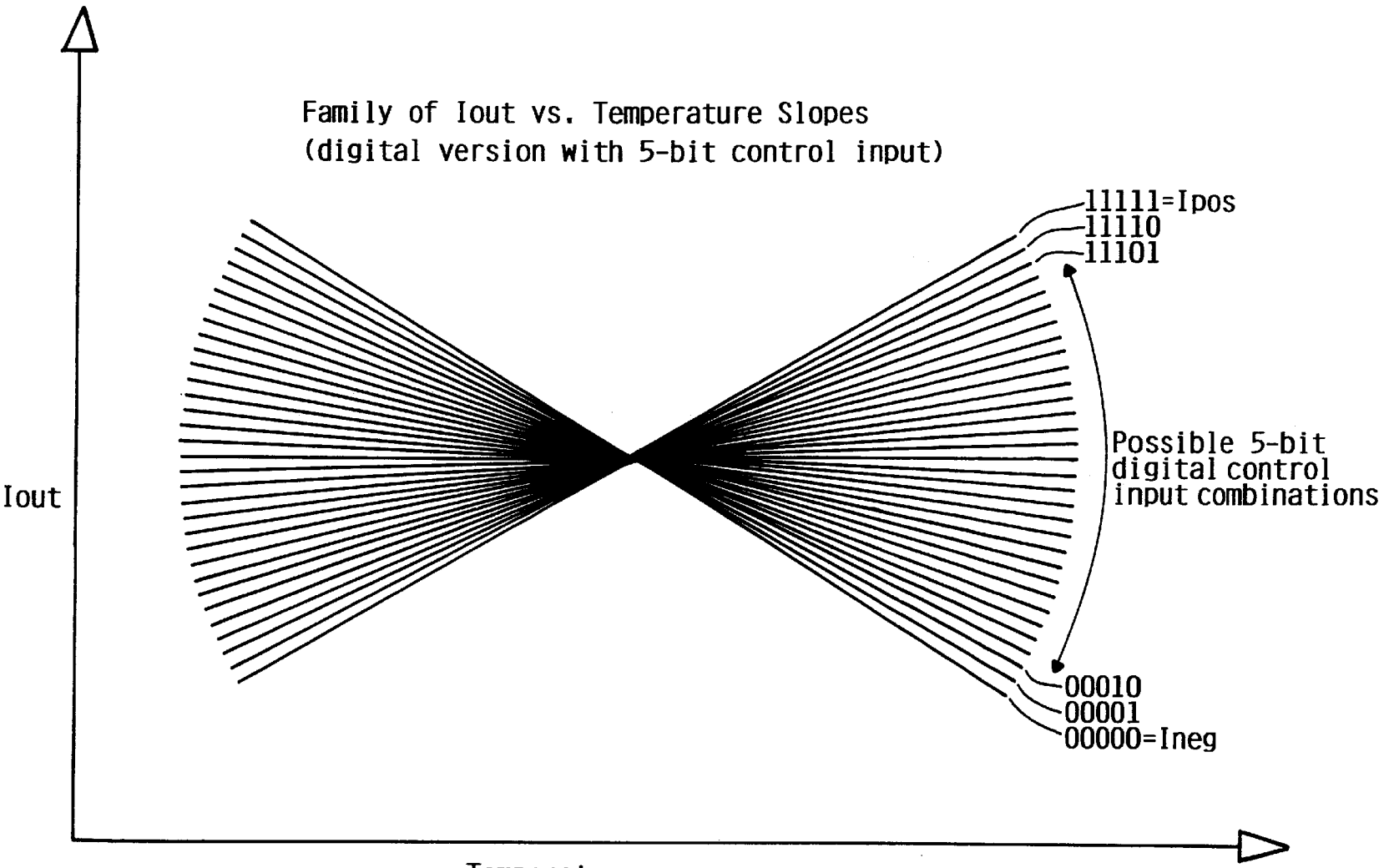
FIG. 6 is a graph of the range of temperature coefficients that may be achieved with a digital embodiment of a constant current source circuit according to the principles of the invention.

FIG. 6 is a fan diagram which illustrates the output current versus temperature graph of a five-bit binary weighted constant current source circuit according to FIG. 4 of the invention. Thus, with reference to FIGS. 4 and 6, when the input to all five input bits 411, 413, 415 . . . 417 is a logic high, then all nfets in the positive temperature coefficient digital-to-analog converter 460 are on. The output current 440 then has temperature coefficient along the line indicated as 11111 in FIG. 6. Similarly, when the input to all five input bits 411, 413, 415 . . . 417 are a logical low, then all nfets in the positive temperature coefficient digital-to-analog converter 460 are off and all the nfets in the negative temperature coefficient digital-to-analog converter 450 are on. In this case, the output current 440 has a negative temperature coefficient along the line indicated by 00000. Discrete steps between these two values are possible as indicated in FIG. 6 by inputting a digital signal to enable particular bit lines. When the digital input signal is between 11111 and 00000, a specified desired ratio of mixed current is output as determined by the selected enable bit lines.

In FIG. 4, the digital-to-analog converter 450 is complementary to digital-to-analog converter 460 in the constant current source circuit. Although certain advantages are achieved with the complementary nature of the constant current source circuit, the constant current source circuit need not have complementary digital-to-analog converters. The constant current source circuit with the matched complementary digital-to-analog converters, on the other hand, is easier to implement. The temperature coefficient can be selected from the entire linear range in discrete steps of temperature coefficients selected from $I_{neg}$ to $I_{pos}$ by changing the mixing ratio of the digital-to-analog converters.

Additionally, greater benefits are realized when a complementary nfet of one digital-to-analog converter matches its corresponding nfet in the complementary digital-to-analog converter. When the least significant bit of one digital-to-analog converter is off, the least significant bit of the complementary digital-to-analog converter is on. To ensure monotonicity of temperature coefficient settings and equal temperature coefficient step sizes, the magnitude of the current that is turned off must match the magnitude of current that is turned on between adjacent control input combinations. Monotonicity of a digital-to-analog converter is harder to achieve with increasing resolution, i.e., number of bits, but by averaging many statistical variances, the effects of single deviations are minimized. For example, in the digital-to-analog converter, the most significant bit has several sources and switches connected in parallel so that if the tolerance of one unit cell falls, there is a statistical possibility of its neighbor rising to compensate. The complementary bits of the two digital-to-analog converters may then be mechanically and electrically configured in spatial proximity to reduce the effects of process variances of separate components. For instance, if the two digital-to-analog converters were separated at a significant relative distance with each occupying an area of 100 $\mu$m by 100 $\mu$m in the same orientation, then complementary unit cells would be at least 100 $\mu$m away. If these complementary nfets are brought spatially closer to be in the same unit cell together, the complementary bits are an order of magnitude closer and better matching is guaranteed.

Figure 7:
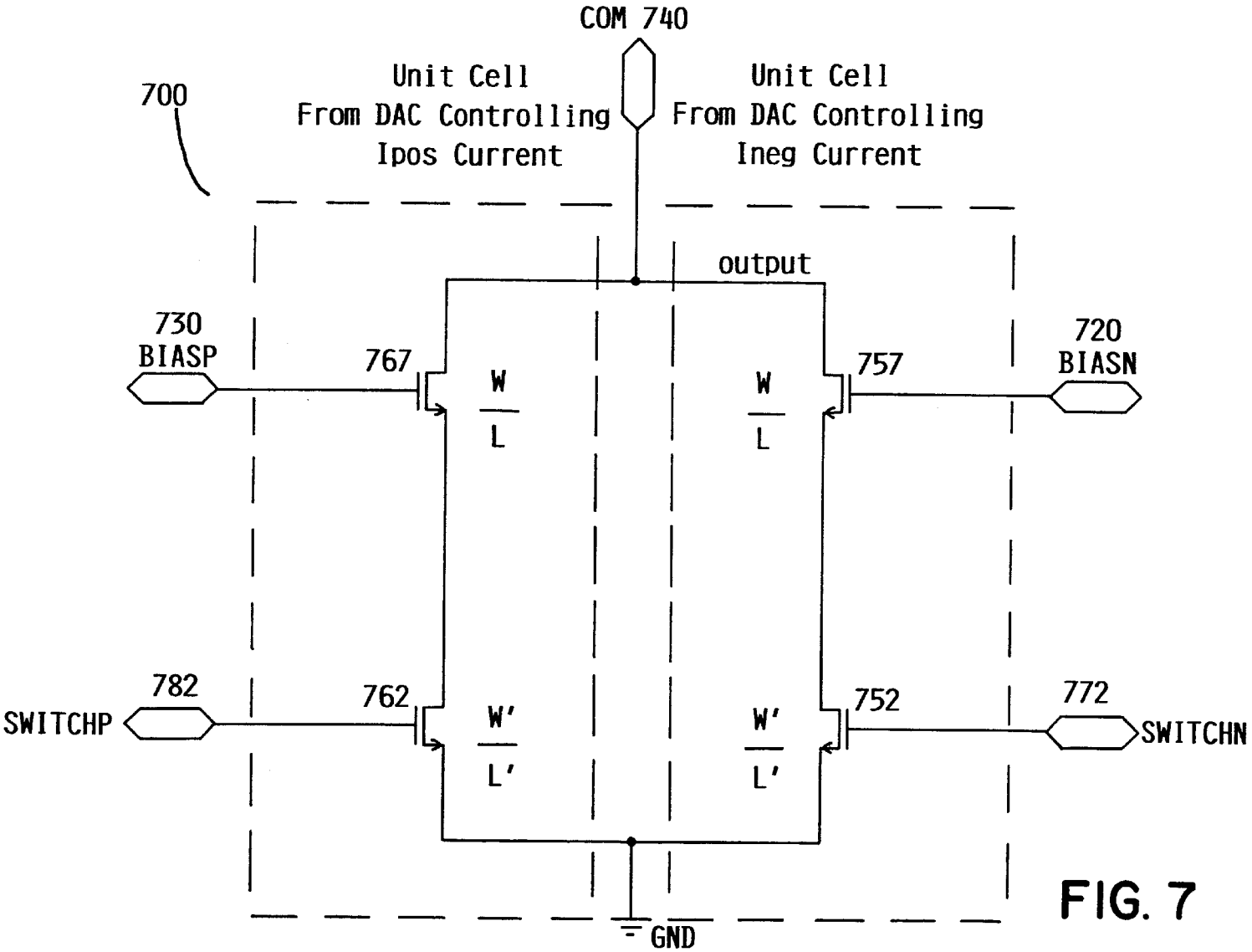
FIG. 7 is a circuit diagram of an integrated complementary unit cell of the invention.

To realize matching by substantially reducing process variations which occur during manufacture of separate semiconductor lots and to enhance monotonicity of temperature coefficient step sizes, the current sources and switches of the matching digital-to-analog converters of FIG. 4 can be implemented in an integrated complementary unit cell 700, illustrated in FIG. 7. Individual differences of the transistors resulting from process and manufacturing variations are minimized and so monotonicity is enhanced by unique "integrated complementary unit cell" and by combining the switch in the unit cell. Each integrated complementary cell 700 has four transistors, which in this embodiment are n-channel enhancement MOSFETs, also referred to as nfets, but the complementary cell could also be embodied as bipolar transistors, depletion MOSFETs, GASFETs, JFETs, even vacuum tubes or any controllable current source will work according to the principles of the invention herein. Nfet 751 is connected to a bias voltage created by negative temperature coefficient source 720, and nfet 761 is connected to a bias voltage created by positive temperature coefficient current source 730. The drain of switch 752 is connected to the source of nfet 751 and its gate is controlled by an enable line 772. The drain of switch 762 is connected to the source of transistor 761 and its gate is controlled by an enable line 782. Thus, when enable line 782 goes high, switch 762 is turned on which allows transistor 761 to conduct current which is a copy of the source having the positive temperature coefficient to output 740. Similarly when enable line 772 goes high, switch 752 is turned on so that transistor 751 conducts a copy of the negative temperature coefficient current source. Preferably enable lines 772 and 782 are connected on opposite ends of an inverter, as shown in FIG. 4, although not shown in FIG. 7. Only one-half of the integrated complementary unit cell will be on at any one time. Each unit cell has the same transistor dimensions, so that equal current will be flowing in every cell. Equal current flow means that the power dissipation will be distributed equally throughout the digital-to-analog converters because each unit cell current conducts the same current regardless of digital input or its physical location in the digital-to-analog converter.

Figure 8A:
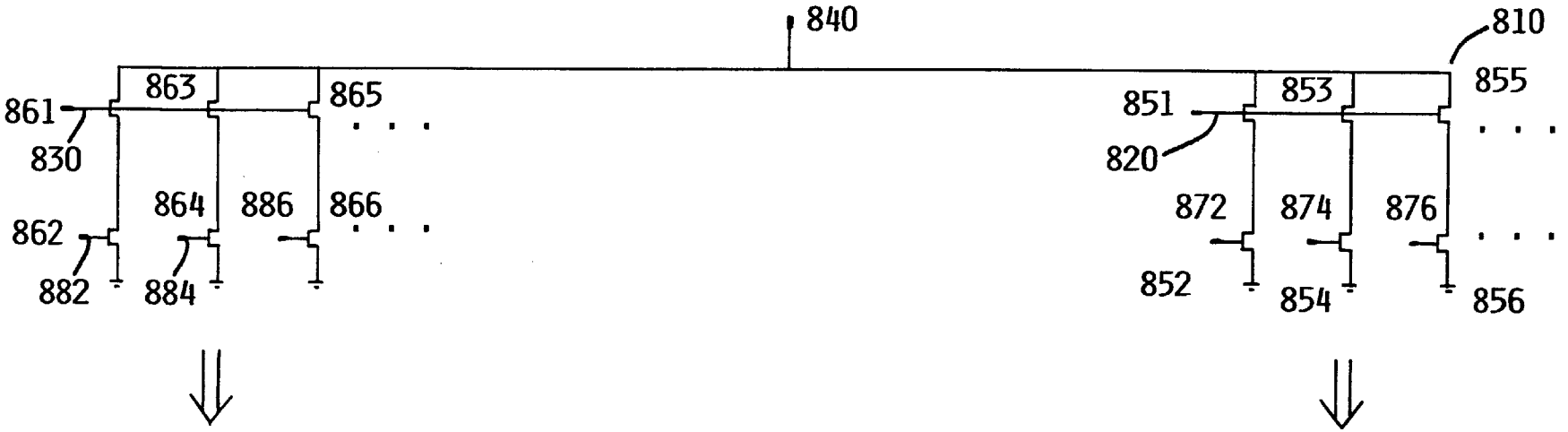
FIGS. 8*a* through 8*d* are circuit diagrams illustrating the evolution of the integrated complementary unit cell in the digital-to-analog converter used in the constant current source circuit according to the principles of the invention.

FIGS. 8*a* through 8*d* illustrate the conceptual development of a complementary unit cell which can be used in the digital-to-analog converters of the constant current source circuit schematically drawn in FIG. 4. FIGS. 8*a* through 8*d* are circuit diagrams of a three-bit digital-to-analog converter according to various principles of the invention. In FIG. 8*a,* transistors 861, 863 and 865 are connected to bias voltage 830 created by a current source having the positive temperature coefficient. Transistor 865 is four times the size as transistor 861 which allows four times the current through transistor 865. Transistor 863 is twice the size with twice the current through it as through transistor 861. Transistors 851, 853, and 855 are connected to the bias voltage 820 created by a current source having the negative temperature coefficient. Transistor 855 is four times the size as transistor 851 allowing four times the current through transistor 855. Transistor 853 is twice the size with twice the current through it as through transistor 851. The transistors are enabled by respective bit lines. Bit line 882, if enabled, will turn on switch 862 allowing current to flow to transistor 861. Bit line 884, if enabled, turns on switch 864 to turn on transistor 863. Bit line 886 controls switch 866 which in turn controls transistor 865. Similarly, bit line 876 controls switch 856 which controls conductance through transistor 855. Bit line 874 controls switch 854 to turn on or off transistor 853; and bit line 872 controls switch 852 which controls transistor 851. To ensure that the magnitude of the current does not change, that only the coefficient of temperature compensation changes, the total number of transistors that are on must be constant. Thus, for every transistor connected to the current source having one polarity for its coefficient of temperature compensation, the corresponding transistor connected to the current source of opposite polarity for its coefficient of temperature compensation must be turned off. In this fashion, transistor 855 is complementary to transistor 865; transistor 853 is complementary to transistor 863, transistor 861 is complementary to transistor 861. Thus, it is preferable to turn a particular transistor on and its corresponding complementary transistor off, i.e., either transistor 851 or transistor 861, either transistor 853 or transistor 863, and either transistor 855 or transistor 865 through the respective corresponding switches 852 or 862, 854 or 864, 856 or 866 enabled by their respective bit lines 872 or 882, 874 or 884, 876 or 886. Current from positive current source 830 and negative current source 820 having the desired coefficient of temperature compensation is blended to output a total current 840 having the net sum of positive and negative temperature coefficients.

Figure 8B:
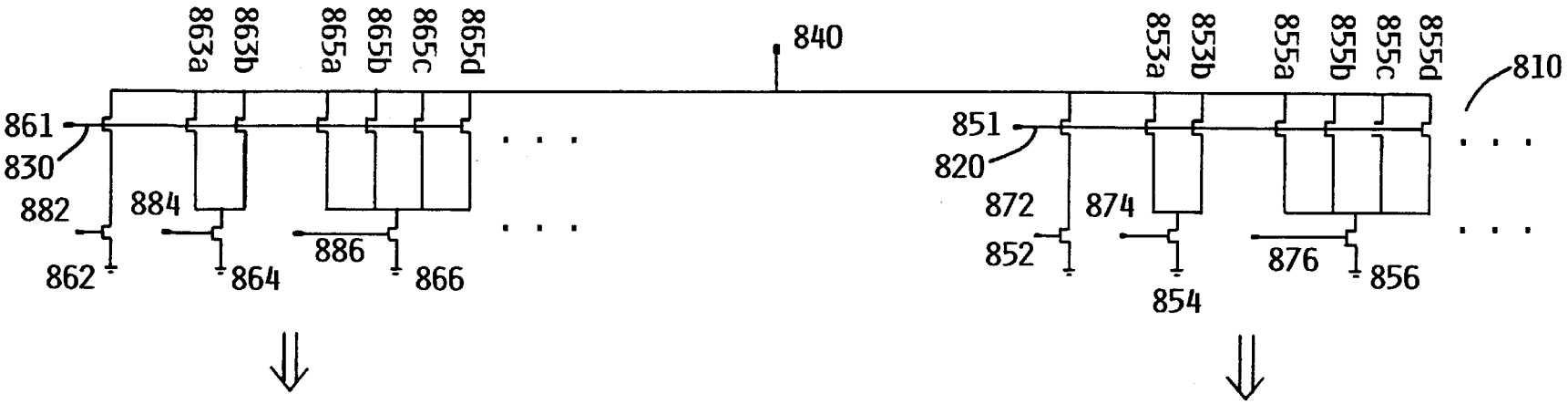

In the circuit of FIG. 8*b,* the single transistor 865 having a value of 4W/L shown in FIG. 8A is now comprised of four identical transistors 865*a,* 865*b,* 865*c,* and 864*d,* each having a value of W/L and connected to a single switch 866 to conduct current. Likewise, transistor 855 having a value of 4W/L is comprised of four transistors 855*a,* 855*b,* 855*c,* and 855*d,* each with of value W/L, each connected to switch 856 enabled by bit line 876. Transistor 853 is comprised of two transistors, 853*a* and 853*b,* each of the same value W/L of transistor 851 and each connected to switch 854 enabled by bit line 874. Transistors 863*a* and 863*b* have a value of W/L and are connected to a single switching transistor 864 enabled by bit line 884. Transistor 851 with a unit value of W/L is connected to switch 852 enabled by bit line 872, while its corresponding complementary transistor 861 has a similar value of W/L and is connected to switch 862 enabled by bit line 882. The bias voltage created by current source with positive temperature coefficient 830 is connected to transistors 861, 863*a,* 863*b,* 865*a,* 865*b,* 865*c,* 865*d;* likewise the bias voltage created by current source with the negative temperature coefficient is connected to transistors 851, 853*a*, 853*b*, 855*a*, 855*b*, 855*c*, 855*d*. If switch 856 is on and switch 866 is off, then current will flow through the four transistors 855*a* through 855*d*. Thus, a stable current having the desired coefficient of temperature compensation can be output at 840 by selecting which bit lines 872–886 to enable to turn on the connected switches 852–866 to permit current to flow through transistors 851–865*d*.

Figure 8C:
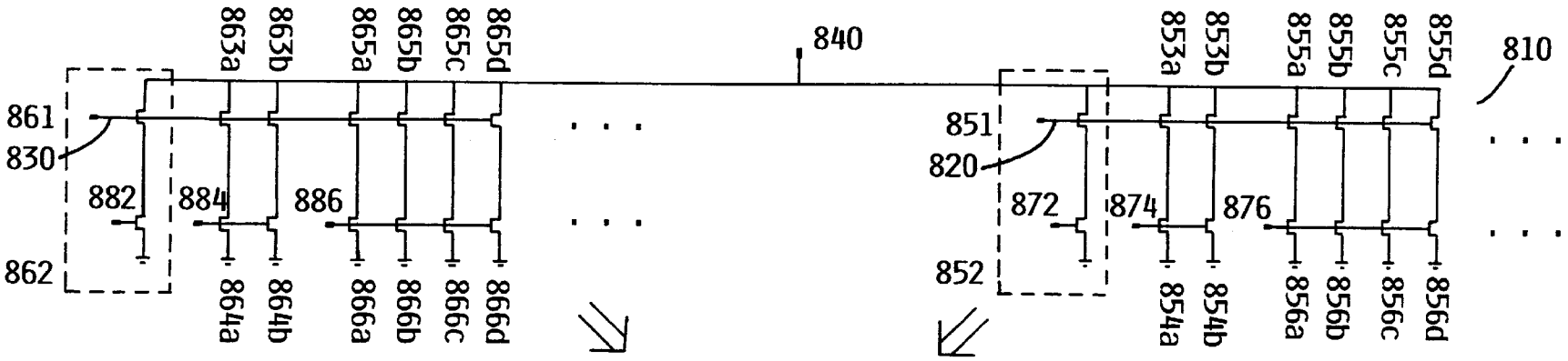

FIG. 8*c* has all the features of FIG. 8*b* and more. Rather than a single transistor switch, transistor switches 852, 854, 856, 862, 864, and 866 are multiple unit transistors, each having a unit value of W/L. For example, control switch 856 in FIGS. 8*a* and 8*b* with a value of 4W/L is now comprised of four transistors 856*a*, 856*b*, 856*c*, 856*d*, each having a value of W/L for a total value of 4W/L, and each of which are electrically connected to a bit line 876 Thus control switch 856*a* controls conductance through transistor 855*a*, switch 856*b* controls transistor 855*b*, switch 856*c* controls switch 855*c*, and switch 856*d* controls switch 855*d*. In a like fashion, control switch 854 of FIGS. 8*a* and 8*b* with a value of 2W/L is now comprised of two transistors 854*a* and 854*b*, each having a value of W/L and each connected to bit line 874. Control transistor 854*a* controls transistor 853*a* and transistor switch 854*b* turns transistor 853*b* on or off. The pattern of electrical connections and control is repeated with respect to those conducting transistors 861 through 865*d* connected to the current source having the positive coefficient of temperature compensation. Control switch 866 in FIGS. 8*a* and 8*b* with a value of 4W/L is now comprised of four transistors 866*a*, 866*b*, 866*c*, 866*d*, each having a value of W/L for a total value of 4W/L, and each of which are electrically connected to a bit line 886. Thus control switch 866*a* controls conductance through transistor 865*a*, switch 866*b* controls transistor 865*b*, switch 866*c* controls switch 865*c*, and switch 866*d* controls switch 865*d*. In a like fashion, control switch 864 of FIGS. 8*a* and 8*b* with a value of 2W/L is now comprised of two transistors 864*a* and 864*b*, each having a value of W/L and each connected to bit line 884. Control transistor 864*a* controls transistor 863*a* and transistor switch 864*b* turns transistor 863*b* on or off.

Figures 2, 8D:
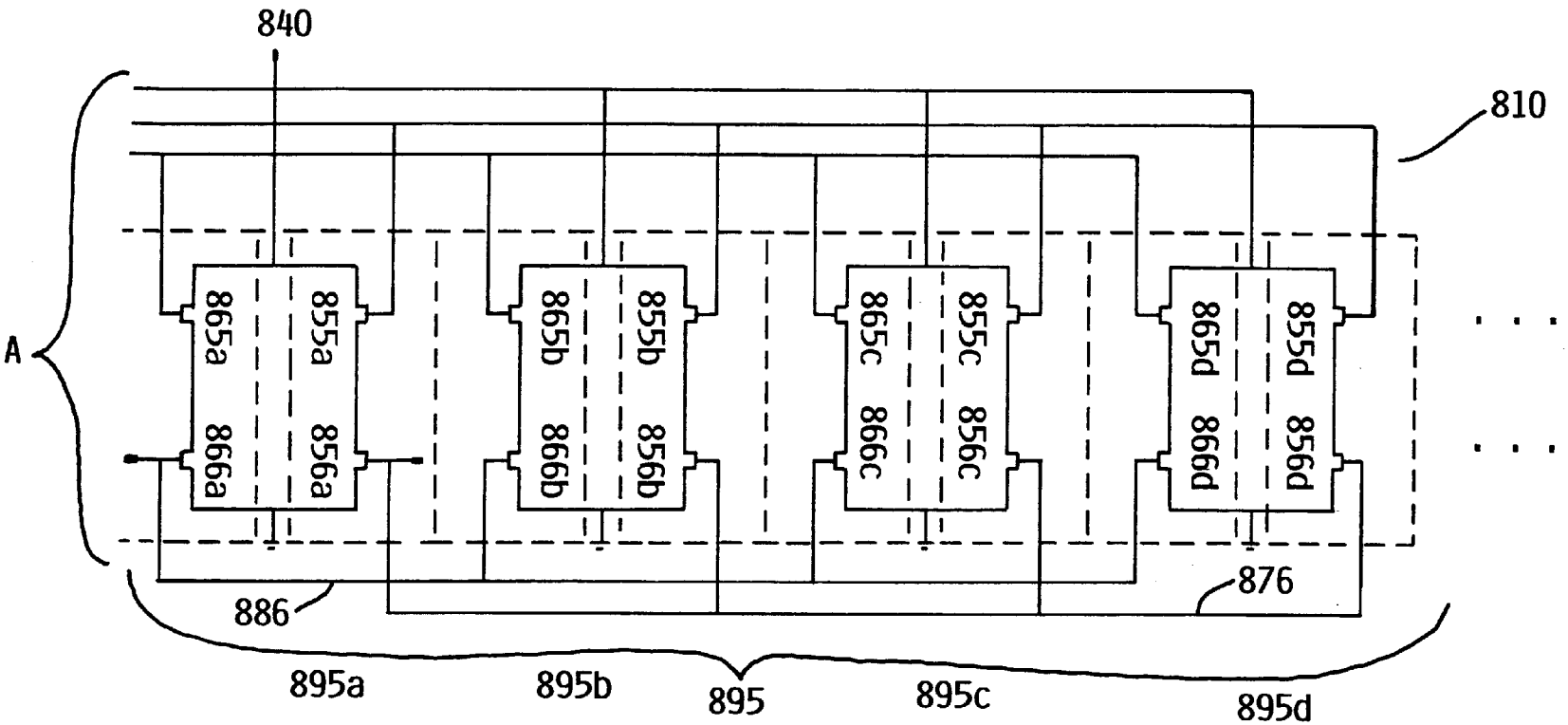

Finally, in FIG. 8*d*, the three-bit digital-to-analog converter 810 incorporates the integrated complementary unit cell of FIG. 7 to obtain statistical averaging and near ideal performance in manufacturing. All conducting transistors are of a unit value and are all connected to the appropriate current source; all control switches are also of another unit value and connected to their respective enabling bit lines. Complementarity is achieved by matching only one switch and its corresponding transistor connected to the bias voltage created by the current source having a negative temperature coefficient with a control switch for a matching transistor connected to the bias voltage created by current source having the positive temperature coefficient. By way of illustration only, for a three-bit digital-to-analog converter, the constant current source circuit then comprises seven complementary unit cells. Bias voltage input 830 of each unit cell is connected to bias voltage created by the positive temperature coefficient current source and bias voltage input 820 of each unit cell is connected to the bias voltage created by negative temperature coefficient current source. To achieve a value of 4W/L, four unit cells are interconnected wherein the transistors on one-half of each unit cell are connected to the positive temperature coefficient current source, and transistors on the other half of each unit cell are connected to the negative temperature coefficient current source. Each transistor is connected to its corresponding switch and all four switches on one-half of each unit cell are connected to the same enable line. The switches on the other half of each complementary unit cell are likewise connected to its enable line. Thus two transistors, each having a value of 4W/L, such as transistor 855 with its respective switch 856 and transistor 865 with its respective switch 866, as shown in FIG. 8*a*, are replaced with four complementary unit cells of FIG. 8*d* as 895*a*, 895*b*, 895*c*, 895*d*.

In the integrated complementary unit cell 700 of FIG. 7, one-half of the cell is on, and one-half is off. When a digital-to-analog converter is comprised of these complementary unit cells, heat is dissipated equally thus eliminating hot spots and improving matching of current flowing in the unit cells. For constant current source circuits having many complementary unit cells, uniform heat dissipation and power distribution is best achieved when the complementary unit cells are arranged in a common centroid arrangement such as shown in FIG. 9. Essentially, the two digital-to-analog converters are miniaturized into multiple complementary unit cells in a common centroid arrangement. Better performance is achieved because of balance by symmetric interspatial placement of unit cells corresponding to particular significant bits. FIG. 9 shows sixty-three complementary unit cells arranged in a nine by seven matrix to achieve a constant current source circuit using a six-bit digital-to-analog converter. In the center of the matrix is the unit cell labeled 1, corresponding to the least significant bit. Equidistant from the center are two cells labeled 2 on opposite ends of the fourth row. Four cells labeled 4 are also spaced equidistant and on opposite sides of center, in rows 2 and 6 at the edges. The most significant bit of the six-bit digital-to-analog converter corresponds to thirty-two unit cells, each of which are positioned symmetrically about the center and labeled 32. All cells along the outer perimeter of the digital-to-analog converter labeled D, D_T, and D_B are dummy cells which are physically identical to the other cells, but they are all off and not connected to the output. The dummy cells ensure equal transistor pattern density around the perimeter of the digital-to-analog converter, as in the interior. The cells labeled R are diode connected reference unit cells which create the bias voltage for the digital-to-analog converters. In the common centroid arrangement as shown, heat is dissipated evenly across the constant current source circuit when the programmable bits are enabled.

While various embodiments of the present invention have been described above, it should be understood that they have been presented by way of example, and not limitation, and variations are possible. For instance, the constant current source circuit of the invention might be mismatched to achieve temperature coefficients in the negative regions or the positive region where zero temperature coefficient does not require the matched controls inputs be in the middle of their range. Given the digital version, if the digital-to-analog converters are matched and 50/50 percent mix is selected, then for a 6-bit digital-to-analog converter, the 0° temperature coefficient control input could lie between binary inputs 011111 and 100000. This would not be the case if a 50/50 mix, again with matched control inputs, were chosen where one digital-to-analog converter was unmatched from the other digital-to-analog converter making the magnitude of the individual output currents having different weights in the final output. In this case 0° temperature coefficient control input would not lie between 011111 and 100000, which are the two settings in the middle of binary 000000 and 111111.

If the control inputs are not matched, then even if the digital-to-analog converters are matched, and the current inputs have equal magnitude but opposite temperature responses, other mixes not possible with matched control inputs, are possible. In the previous six-bit control example, one can select the following thirty-one mixing rations: 0/31, 1/31, 2/29, 3/28, 4/27 . . . 27/4, 28/3, 29/2, 30/1, 31/0. In case where the digital control inputs are not driven complementarily, mixes of 0/0 with no current, 1/1 with a 50 percent mix, or 31/31 having thirty-one times the magnitude of the former combination are possible. Thus, the breadth and scope of the present invention should not be limited by any of the above-described exemplary embodiments, but should be defined only in accordance with the following claims and their equivalents.

What is claimed is:

1. A constant current source circuit, comprising:

a first current source having a positive coefficient of temperature compensation to generate a first bias voltage connected to a first voltage-controlled current source;

a second current source having a negative coefficient of temperature compensation to generate a second bias voltage connected to a second voltage-controlled current source;

a first current selector comprising at least two transistors; the source/emitter of a first and a second transistor connected to the first voltage-controlled current source; the gate/base of the first transistor connected to a bandgap reference voltage and the drain/collector of the first transistor connected to a constant voltage; the gate/base of the second transistor connected to a variable control voltage;

a second current selector comprising at least two transistors, the source/emitter of a third and fourth transistors connected to the second voltage-controlled current source; the gate/base of the third transistor connected to the bandgap reference voltage, the drain/collector of the third transistor connected to the drain/collector of the second transistor; the gate/base of the fourth transistor connected to the variable control voltage, and the drain/collector of the fourth transistor connected to the constant voltage;

an output current derived from selectively combining current from the second and third transistors of the first and second current selectors, respectively.

2. The constant current source circuit of claim 1 wherein the transistors are selected from the group consisting of pnp bipolar transistors, p-channel enhancement MOSFETs, p-channel depletion MOSFETs, GASFETs, JFETs, npn bipolar transistors, n-channel enhancement MOSFETs, n-channel depletion MOSFETs, GASFETs, or JFETs.

3. The constant current source circuit of claim 1, wherein as the variable control voltage increases, the partial derivative of the output current with respect to temperature decreases.

4. The constant current source circuit of claim 1, wherein as the variable control voltage decreases, the partial derivative of the output current with respect to temperature increases.

5. The constant current source circuit of claim 1 wherein as the variable control voltage increases, the partial derivative of the output current with respect to temperature increases.

6. The constant current source circuit of claim 1 wherein as the variable control voltage decreases, the partial derivative of the output current with respect to temperature decreases.

7. A constant current source circuit, comprising:

a first current source having a positive coefficient of temperature compensation to generate a first bias voltage;

a second current source having a negative coefficient of temperature compensation to generate a second bias voltage;

at least one first transistor connected to the first bias voltage;

at least one second transistor connected to the second bias voltage;

a first programmable enable switch connected to the first transistor to enable the first transistor to conduct current having a positive coefficient of temperature compensation;

a second programmable enable switch connected to the second transistor to enable the second transistor to conduct current having a negative coefficient of temperature compensation;

an output current combining current from those transistors which have been enabled to conduct current.

8. The constant current source circuit of claim 7 further comprising:

an inverter between and connecting the first programmable enable switch and the second programmable enable switch, and the first and second transistors have the same physical dimensions, such that only one of the first or second transistor is on at any one time.

9. The constant current source circuit of claim 7 wherein the first transistor and first programmable enable switch, and the second transistor and second programmable enable switch are configured into an integrated complementary unit cell.

10. A constant current source circuit, comprising:

a first n-bit digital-to-analog converter electrically connected to a first current source having a positive coefficient of temperature compensation, where $n \geqq 1$;

a second m-bit digital-to-analog converter electrically connected to a second current source having a negative coefficient of temperature compensation, where $m \geqq 1$;

at least n first programmable enable lines connected to the first n-bit digital-to-analog converter;

at least m second programmable enable lines connected to the second m-bit digital-to-analog converter;

a mixed output of a first current output of the first digital-to-analog converter added to a second current output of the second digital-to-analog converter having a net temperature coefficient determined by the number of the first and the second programmable enable lines that are on.

11. A constant current source circuit, comprising:

a first n-bit digital-to-analog converter electrically connected to a first current source having a positive coefficient of temperature compensation, where $n \geqq 1$;

a second m-bit digital-to-analog converter electrically connected to a second current source having a negative coefficient of temperature compensation, where $m \geqq 1$;

at least n first programmable enable lines connected to the first n-bit digital-to-analog converter;

at least m second programmable enable lines connected to the second m-bit digital-to-analog converter;

a mixed output of a first current output of the first digital-to-analog converter added to a second current output of the second digital-to-analog converter having a net temperature coefficient determined by the number of the first and the second programmable enable lines that are on, wherein n=m and the first n-bit digital-to-analog converter and the second m-bit digital-to-analog converter further comprises $$\sum_{n=0}^{n} 2^n$$

integrated complimentary unit cells in a common centroid arrangement.

12. A constant current source circuit, comprising:

means to generate a first bias voltage having a positive temperature coefficient;

means to generate a second bias voltage having a negative temperature coefficient;

first current generating means responsive to said first bias voltage to generate a first current having a positive temperature coefficient, said first current generating means comprising two transistors, the gate of a first transistor connected to an adjustable control voltage and the drain of said first transistor connected to an output, and the gate of a second transistor connected to a bandgap reference voltage and the drain of said second transistor connected to a fixed voltage;

second current generating means responsive to said second bias voltage to generate a second current having a negative temperature coefficient, said second current generating means comprises two transistors, the gate of a third transistor connected to said adjustable control voltage and the drain of said third transistor connected to said fixed voltage, the gate of a fourth transistor connected to said bandgap reference voltage and the drain of said fourth transistor connected to said output: and;

means to output a mixed current by selectively adding varying amounts of said first current and said second current by adding said outputs of said first and said fourth transistors as determined by the difference between said bandgap reference voltage and said adjustable control voltage.

13. The constant current source circuit of claim 12 wherein said first current generating means comprises a first n-bit digital-to-analog converter;

said second current generating means comprises a second m-bit digital-to-analog converter;

said output means comprises means to selectively enable any of said n bits of said first digital-to-analog converter to output a first output current;

means to selectively enable any of said m bits of said second digital-to-analog converter to output a second output current; and means to add said first and said second output currents.

14. The constant current source circuit of claim 13 wherein said n-bits of said first digital-to-analog converter are complementary to said m-bits of said second digital-to-analog converter and n=m;

said means to selectively enable said n-bits of said first digital-to-analog converter further comprises switching means interconnected between said means to selectively enable said m-bits of said second digital-to-analog converter wherein when one of said n-bits of said first digital-to-analog converter is on, the complementary one of said m-bits of said second digital-to-analog converter is off.

* * * * *